United States Patent [19]

Long et al.

[11] Patent Number: 4,929,151

[45] Date of Patent: May 29, 1990

[54] VACUUM PUMP

[75] Inventors: Jacques Long, Annecy; Denis Perrillat-Amédé, Annecy Le Vieux, both of France

[73] Assignee: Societe Anonyme dite: Alcatel Cit, Paris, France

[21] Appl. No.: 369,401

[22] Filed: Jun. 21, 1989

[30] Foreign Application Priority Data

Jul. 27, 1988 [FR] France ..... 88 10120

[51] Int. Cl.[5] ..... F01D 5/08

[52] U.S. Cl. ..... 415/177; 415/90

[58] Field of Search ..... 415/90, 175, 177, 214.1

[56] References Cited

U.S. PATENT DOCUMENTS

| | | | |
|---|---|---|---|
| 4,797,062 | 1/1989 | Deters et al. | 415/177 |
| 4,804,313 | 2/1989 | Nasvytis | 415/177 |

FOREIGN PATENT DOCUMENTS

| | | | |
|---|---|---|---|
| 1935603 | 1/1971 | Fed. Rep. of Germany . | |
| 3716221 | 11/1987 | Fed. Rep. of Germany | 415/90 |
| 1304689 | 6/1963 | France . | |
| 46394 | 3/1984 | Japan | 415/90 |
| 255594 | 10/1988 | Japan | 415/90 |
| 63698 | 3/1989 | Japan | 415/90 |
| 533757 | 12/1976 | U.S.S.R. | 415/90 |
| 1418495 | 8/1988 | U.S.S.R. | 415/90 |

OTHER PUBLICATIONS

European Patent No. 197,238, Nov. 1986.

*Primary Examiner*—Robert E. Garrett
*Assistant Examiner*—John T. Kwon
*Attorney, Agent, or Firm*—Sughrue, Mion, Zinn, Macpeak & Seas

[57] ABSTRACT

A molecular or turbomolecular type of pump comprising a stator (2) and a rotor (3) rotated by a motor (7), the stator having a first zone overlying the rotor and in which gas is admitted, and a second zone adjacent to the drive motor and cooled by a flow of fluid (8), the pump being characterized in that the first zone is provided with heater (12) for maintaining the temperature of the first zone above the condensation threshold of the gas being admitted, with the first and second zones being separated from each other by a thermal impedance element (13).

4 Claims, 1 Drawing Sheet

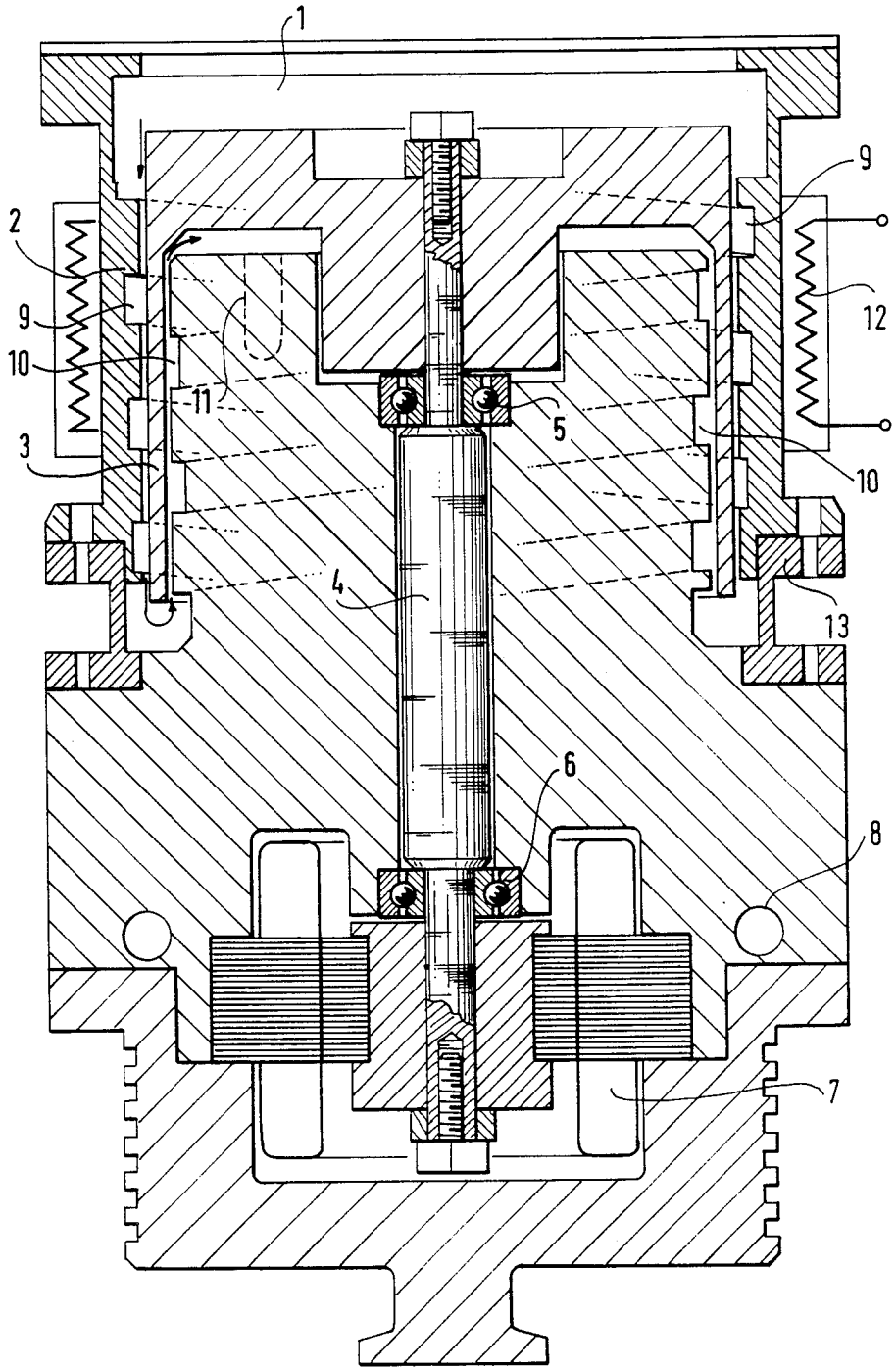
1
2
9
10
11
3
4
5
6
7
8
9
12
10
13

VACUUM PUMP

The present invention relates to a vacuum pump of the molecular or the turbomolecular type.

BACKGROUND OF THE INVENTION

At present, molecular and turbomolecular pumps should avoid pumping certain gases because they are liable to condense on the pump walls at low temperature, and because of the compression exerted by the pump. These liquid or solid condensates can give rise to damage, obstruction, or jamming of the pump. The reason for this condensation is that present pumps are cooled in order to evacuate the heat dissipated by the driving electric motor, together with the heat developed by compressing the gas. Consequently, the temperature of the inside walls of the pump is close to ambient, thereby greatly encouraging condensation.

An object of the present invention is to provide a vacuum pump provided with means for avoiding any danger of condensation.

SUMMARY OF THE INVENTION

The present invention provides a molecular or turbomolecular type of pump comprising a stator and a rotor rotated by a motor, the stator having a first zone overlying the rotor and in which gas is admitted, and a second zone adjacent to the drive motor and cooled by a flow of fluid, wherein the first zone is provided with heater means for maintaining the temperature of said zone above the condensation threshold of the gas being admitted, with the first and second zones being separated from each other by a thermal impedance element.

Advantageously, said heater means is constituted by a heating collar surrounding at least a portion of the first zone of the stator.

Preferably, said thermal impedance element is a ring or washer made of a material selected from: stainless steel; ceramics; and synthetic material.

BRIEF DESCRIPTION OF THE DRAWING

An embodiment of the invention is described by way of example with reference to the accompanying drawing, in which the sole figure is a diagrammatic view, partially in axial section, through a molecular pump in accordance with the invention.

DETAILED DESCRIPTION

In the figure, reference 1 designates the suction orifice of the pump. The pump comprises a stator 2 and a rotor 3. The rotor is fixed to a shaft 4 and rotates on ball bearings 5 and 6. The shaft is rotated by an electric motor 7.

The heat dissipated by the pump is evacuated by a flow of water 8.

The gas admitted at 1 is compressed going from the top of the figure towards the bottom by means of a helical section groove 9 of decreasing cross-section, and compression then continues going up the figure in another groove 10 of decreasing cross-section. Delivery is performed downwards via a duct 11.

In accordance with the invention, the pump is provided with means for maintaining that portion of the stator which is in contact with the gas at a temperature which is higher than the condensation temperature of the gas admitted. In order to achieve this result, a heating collar 12 may be used as shown in the figure in contact with the stator at least over a portion thereof overlying the suction grooves.

The remainder of the pump is kept at a low temperature by the flow of water.

In addition, a thermal impedance element 13 is disposed between that portion of the stator which is maintained at low temperature (adjacent to the motor), and the heated portion of the stator (adjacent to the compression grooves).

This element sets up a thermal barrier between the two portions of the stator and prevents the heat delivered by the heater element from being immediately dissipated in the cooling water flow.

The thermal impedance element may be a ring or washer of stainless steel, or of ceramic, or of synthetic material The thermal impedance element 13 makes it possible to maintain a temperature difference $\delta\theta$ between the two portions of the stator equal to P/c, where P designates the power delivered by the heater element 12, and c designates the thermal conductance of the element 13.

For example, a thermal impedance element having a conductance of 1 watt/° C. associated with a 40 watt heater element enables a temperature difference close to 40° C. to be maintained.

The nature, the shape, and the material of the thermal impedance element are selected as a function of the desired temperature difference, given the nature of the gas to be pumped and the power of the heater element.

The invention is applicable to any molecular or turbomolecular type of pump, in particular in applications for the chemical industry and the semiconductor industry.

What is claimed:

1. A molecular or turbomolecular type of pump comprising a stator and a rotor rotated by a motor, the stator having a first zone overlying the rotor and in which gas is admitted, and a second zone adjacent to the drive motor and cooled by a flow of fluid, wherein the first zone is provided with heater means for maintaining the temperature of said zone above the condensation threshold of the gas being admitted, with the first and second zones being separated from each other by a thermal impedance element.

2. A pump according to claim 1, wherein said heater means is constituted by a heating collar surrounding at least a portion of the first zone of the stator.

3. A pump according to claim 1 or 2, wherein said thermal impedance element is a ring or washer made of a material selected from stainless steel; ceramics; and synthetic material.

4. A pump according to claim 2, wherein said thermal impedance element is a ring or washer made of a material selected from stainless steel, ceramics, and synthetic material.

* * * * *